United States Patent [19]

Miyamoto et al.

[11] 4,012,538

[45] Mar. 15, 1977

[54] METHOD OF FORMING COLOR IMAGES EMPLOYING DESENSITIZING AGENTS

[75] Inventors: Akio Miyamoto; Hiroharu Matsukawa, both of Fujinomiya, Japan

[73] Assignee: Fuji Photo Film Co., Ltd., Minami-ashigara, Japan

[22] Filed: Mar. 31, 1975

[21] Appl. No.: 563,902

Related U.S. Application Data

[63] Continuation of Ser. No. 425,902, Dec. 17, 1973, abandoned.

[30] Foreign Application Priority Data

Dec. 18, 1972 Japan ..... 47-126861

[52] U.S. Cl. ..... 427/145; 282/27.5; 427/150; 427/151

[51] Int. Cl.[2] ..... B41M 5/12; B41M 5/18

[58] Field of Search ..... 96/56.5, 62, 101; 260/239 B, 309.6, 251 R; 106/19; 252/401; 427/151, 261, 146, 150, 149, 151; 282/27.5

[56] References Cited

UNITED STATES PATENTS

| | | | |
|---|---|---|---|
| 2,777,780 | 1/1957 | Cormack et al. | 427/151 X |
| 3,053,788 | 9/1962 | Blackman et al. | 260/309.6 |
| 3,210,312 | 10/1965 | Rosenberg et al. | 260/309.6 |
| 3,316,232 | 4/1967 | McGann | 260/309.6 |
| 3,364,052 | 1/1968 | Martino | 427/261 X |
| 3,814,707 | 6/1974 | Moller et al. | 260/309.6 |

*Primary Examiner*—Thomas J. Herbert, Jr.
*Attorney, Agent, or Firm*—Sughrue, Rothwell, Mion, Zinn & Macpeak

[57] ABSTRACT

A desensitizer composition containing at least one of an amidine represented by the general formula (I)

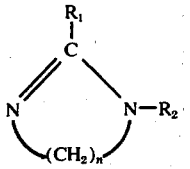

(I)

wherein $R_1$ and $R_2$ each represent an alkyl group having 1 to 8 carbon atoms, $R_1$ and $R_2$ can form a $C_2$ to $C_{11}$ ring which can be substituted by alkyl groups having 1 to 4 carbon atoms, and *n* represents 2 to 6, or a derivative of the amidine.

13 Claims, No Drawings

METHOD OF FORMING COLOR IMAGES EMPLOYING DESENSITIZING AGENTS

This is a continuation of application Ser. No. 425,902, filed Dec. 17, 1973 now abandoned.

BACKGROUND OF THE INVENTION

1. Field of the Invention

The present invention relates to desensitizer compositions. In more detail, the present invention relates to desensitizer compositions which decrease or eliminate the function of developers which cause coloration when contacted with substantially colorless color formers.

2. Description of the Prior Art

It is well known that color images are formed by the contact between color formers which are substantially colorless organic compound and developers. For instance, these color forming reactions are utilized in the recording materials described in U.S. Pat. Nos. 2,505,470; 2,505,489; 2,548,366; and 2,550,471, the recording materials described in U.S. Pat. Nos. 2,712,507; 2,730,457; and 3,293,060, the recording materials described in U.S. patent application Ser. No. 40,732 filed May 26, 1970 and British Pat. No. 825,354, and other recording materials such as for spirit printing, for stencil printing, in automatic vending systems, in the fingerprinting system and in the letter writing systems, etc.

In these recording materials, it is preferred for efficiency and economy to prevent the color-forming reaction on parts where formation of color images is not required by some means, because the color former and the developer form a color if they contact each other. Hitherto, desensitizers have been used for this purpose. For example, desensitizers as described in U.S. Pat. No. 2,777,780 (primary alkyl amines having a high molecular weight such as dodecylamine, quaternary ammonium salts such as dodecyl-trimethylammonium chloride, and alkyl or arylamine acetates), Japanese Patent Publication No. 29546/1971 (monoalkylamines, aralkylamines or tertiary amines in which ethanolamines chemically combine with ethyleneoxide groups), Japanese Patent Publication No. 35697/1971 (precondensates of urea resins), and others (secondary alkylamines such as didodecylamine, tertiary amines such as triethylamine, primary amines such as aniline, aralkyl amines such as benzylamine and polyhydroxyl compounds such as polyethylene glycol and glycerine, etc.) are known.

However, these desensitizers have disadvantages in that they have an insufficient desensitizing function or in that a practical effect is not obtained, even when they have a sufficient desensitizing function, if they are not used in a sufficient amount. Thus, with certain desensitizers, coloring can occur even if the desensitizers are used in a large amount. With other desensitizers, coloration can occur if the desensitizers are not used in a large amount. Particularly, these disadvantages become greater with the improvements made in color formers and developers.

For example, from a practical standpoint it is difficult to desensitize color formers having a fluoran ring as compared with Crystal Violet lactone etc. Further, these desensitizers barely show any desensitizing function for developers such as phenol resins and metal salts of aromatic carboxylic acids. Consequently, the advantageous properties of these developers (e.g. a property that the color image formed by using these developers does not disappear when contacted with water) cannot be utilized effectively. Another defect of these prior art desensitizers is that the undesensitized parts of the developers color with the lapse of time (the so-called generation of fog) when the desensitized developers are brought into contact with an encapsulated color former solution.

Further, the prior desensitizers yellow on the developers or they have the disadvantage that it is difficult to increase the coating (printing) speed because of a low drying rate, since they must be used in a large amount.

Accordingly, an object of the present invention is to provide desensitizer compositions having a high desensitizing function.

Another object of the present invention is to provide desensitizer compositions having a good coating tendency which can be used whether they are in an aqueous state or in an oily state.

A further object of the present invention is to provide desensitizer compositions which do not adversely influence color formers, developers and systems containing color formers and developers.

SUMMARY OF THE INVENTION

As the result of many studies, the present inventors have found that the above objects of the present invention can be attained by using cycloamidines represented by the following formula or derivatives thereof as the desensitizer component:

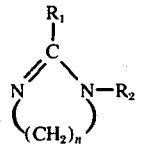

wherein $R_1$ and $R_2$ each represents a hydrogen atom, an alkyl group having 1 to 8 carbon atoms, $R_1$ and $R_2$ can form a ring having 2 to 11 methylene groups, wherein this ring can be substituted by alkyl groups having 1 to 4 carbon atoms, and $n$ represents 2 to 6.

DETAILED DESCRIPTION OF THE INVENTION

The cycloamidines are known compounds, which are described, for example, in Japanese Patent Publication No. 37503/1971.

Suitable examples of alkyl groups are methyl, ethyl, propyl, butyl and octyl. Preferably alkyl groups having 1 to 4 carbon atoms are used.

Examples of suitable cycloamidines include 1-methylimidazoline, 1,2-dimethylimidazoline, 1-methyl-2-ethylimidazoline, 1-methyl-2-octylimidazoline, 1-methyl-1,4,5,6-tetrahydropyrimidine, 1,2-dimethyl-1,4,5,6-tetrahydropyrimidine, 1-methyl-2-ethyl-1,4,5,6-tetrahydropyrimidine, 1-methyl-2-butyl-1,4,5,6-tetrahydropyrimidine, 1-ethyl-2-octyl-1,4,5,6-tetrahydropyrimidine and 1,2,4-trimethyl-1,4,5,6-tetrahydropyrimidine.

The cycloamidine derivatives which are suitable are a reaction product, e.g., salts, of cycloamidines and acid materials (phenols and carboxylic acids, etc.). The phenols include monohydric phenols such as phenol, cresols, xylenols, naphthols, trimethylphenols, tetramethylphenols, pentamethylphenols, n- and iso-propylphenols, n- and iso-butylphenols, cyclohexylphenols, n- and iso-amylphenols, octylphenols, nonylphenols, dodecylphenols, di- and poly-substituted phenols (e.g. thymol, carvacrol and di- and iso-alkylphenols) and methoxyphenols (e.g. eugenol and guaiacol); dihydric phenols such as catechols, resorcinols, hydroquinones and bisphenols; and polyhydric phenols such as pyrogallol and phloroglucinol. Preferred phenols are those substituted with an alkyl group having 1 to 12 carbon atoms, a hydroxyl group, a cyclohexyl group, an alkoxy group having 1 to 2 carbon atoms and a carboxyl group.

The carboxylic acids having from 1 to 20 carbon atoms include saturated aliphatic acids such as formic acid, acetic acid, propionic acid, butyric acid, valeric acid, caproic acid, enanthic acid, caprylic acid; pelagonic acid, capric acid undecylic acid, lauric acid, tridecyclic acid, myristic acid, pentadecylic acid, palmitic acid, heptadecylic acid and stearic acid, unsaturated aliphatic acids having 2 to 3 olefinic bonds such as acrylic acid, crotonic acid, isocrotonic acid, undecylenic acid, oleic acid, elaidic acid, cetoleic acid, erucic acid, brassidic acid, sorbic acid, linolic acid, linolenic acid, arachidonic acid, propionic acid and stearolic acid, isoalkyl aliphatic acids such as 2-ethylhexanoic acid and hydroxy aliphatic acids having 1 to 2 hydroxy groups such as lactic acid, glycolic acid, ricinolic acid and oxystearic acid. As other acids, there are weak acids such as benzoic acid, salicylic acid, enolic acid (e.g. barbatolic acid), carbonic acid and phosphoric acid. Preferred carboxylic acids are fatty acids and hydroxyfatty acids having 2 to 20 carbon atoms.

The cycloamidine derivatives can be prepared by merely reacting at temperatures ranging from about 5° to 80° C, preferably 15° to 50° C the above-described cycloamidines with the above-described acids. In this case, the reaction ratio of both can be equivalent, or the cycloamidines can be used in an excess amount or the acid component can be used in an excess amount.

Formation of the cycloamidine derivatives can be easily carried out at a room temperature without using any catalyst. However, when solid acids are used, it is preferred to use inert volatile solvents such as benzene, toluene, xylene, hexane and heptane etc., and at a concentration ranging from about 1 to 90% by weight. These solvents can be easily removed in any suitable way (e.g., evaporation) after conclusion of the reaction.

Many of these derivatives are nearly colorless liquids having essentially no bad odor and are soluble in aromatic hydrocarbon solvents such as toluene, xylene, etc.; esters such as ethyl acetate, isopropyl acetate, butyl acetate, etc.; and alcohols such as ethanol, propanol, etc.; or are easily soluble or dispersable in water.

The compounds of the present invention show the same degree of desensitization as that of the prior art desensitizer compounds even though they are used in a smaller amount than that of the prior art desensitizer compounds. As a standard, they show sufficient desensitizing effect when used in an amount at least ⅓ (by weight) of that of the prior desensitizer compounds. Generally a suitable amount of the desensitizer compound of this invention ranges from about 0.5 to 10 g/m², preferably 0.7 to 5.0 g/m².

Of course, a better desensitizing effect is obtained when they are used in an amount above ⅓. Therefore, the above described value, that is ⅓ of the amount of the prior desensitizer compounds, is based only on economic considerations.

On the other hand, when the compounds of the present invention are used in the amount less than ⅓ of the prior compounds, the desensitizing effect decreases as the amount used decreases. However, the amount of the compounds of the present invention is not limited, if one considers the fact that the compounds of the present invention give a far more excellent effect than the prior art known desensitizers when they are used in the same amount as with the prior art desensitizers. The desensitizer compositions of the present invention can contain any optional and conventionally contained components of desensitizer compositions as long as they contain at least one of the above described cycloamidines or derivatives thereof.

These other components which can be used in desensitizer compositions include natural or synthetic high molecular weight compounds (in many cases, they are used as a binder, but these compounds are not necessarily limited to a binder function) which are included in the prior art desensitizer compositions, such as ketone resins, polyamide resins, maleic acid resins, fumaric acid resins, phenol resins, epoxy resins, alkyd resins, melamine resins, urea resins, acrylic resins, nitrocellulose, methylcellulose, cellulose acetate butyrate, butyral resins, casein, gelatin and polyvinyl alcohol etc.; pigments (which improve printability, whiteness and hiding power) such as titanium oxide, zinc oxide, barium sulfate, magnesium carbonate, calcium carbonate, barium carbonate magnesium hydroxide and talc; solvents such as glycols (e.g., ethylene glycol, diethylene glycol, glycerol, polyethylene glycol and polypropylene glycol) and alcohols such as methyl alcohol, ethyl alcohol, propyl alcohol, and butyl alcohol; paraffins, fats (as lubricants) such as Japan wax, drying oils (e.g., linseed oil, tung oil and soy bean oil), semi-drying oils (e.g., cotton seed oil, rape seed oil and rice bran oil); known additives, for example, offset preventing agents such as starch and other conventional desensitizers. These components can be employed in desensitizer compositions in an amount of about 5 to 30% by weight for the resins, about 5 to 60% by weight for the pigments, about 5 to 40% by weight, for the solvents, about 0.5 to 10% by weight for the lubricants and 0.1 to 2% by weight for the offset preventing agents. The compositions of the present invention can be used in many form, for example, as an aqueous solution, as a solution in organic solvents (e.g., an alcoholic solution), as an aqueous dispersion, as a paste and as a solid a suitable concentration for these forms can range from 5 to 80% by weight, preferably 20 to 60% by weight. The function of the above described compositions is not lost due to the kind and the amount of the other components included in the composition or by the form of the composition.

Thus, the desensitizer compositions using the desensitizer of the invention can be easily prepared by persons skilled in the art and can be applied to the developer by printing using techniques such as relief printing and gravure printing, by spraying or by writing with a crayon or an eraser etc.

The developers to which the desensitizer compositions of the present invention are applied are electron accepting substances, which are well known in this field. These color developers are described in U.S. Pat. Nos. 2,711,375; 2,712,507; 2,730,456; 2,777,780; 2,800,457; 3,293,060; 3,427,180; 3,455,721; 3,466,185; 3,516,845; 3,634,121 and 3,672,935, U.S. patent applications Ser. No. 184,608, filed Sept. 28, 1971; Ser. No. 183,647, filed Sept. 24, 1971; Ser. No. 192,593, filed, Oct. 26, 1971 and Ser. No. 192,594, filed Oct. 26, 1971, and the like. Examples of such developers include clays such as acid clay and attapulgite, organic acids such as tannic acid, gallic acid and propyl gallate, metal salts of aromatic carboxylic acids such as zinc salicylate, tin salicylate, zinc 2-hydroxynaphthoate and zinc 3,5-di-tert-butylsalicylate, acid polymers such as phenol-formaldehyde condensate resins and phenol-acetylene condensate resins, and mixtures of these materials.

The color developer is applied to a support such as paper, plastic film-laminated papers, etc., together with a binder such as a styrene-butadiene latex, in an amount of 1 to 90, preferably 5 to 80, parts by weight per 100 parts by weight of the color developer composition calculated on a solids basis.

The color developer composition may contain a binder such as latex, polyvinyl alcohol, maleic anhydride-styrene copolymer, starch and gum arabic. It is to be understood that all binders well-known as film-forming materials can be used in the invention. The binders can be classified into three groups, i.e., (1) a water soluble or hydrophilic binder, for example, a natural compound such as proteins (e.g., gelatin, gum arabic, colloid albumin, casein), celluloses (e.g., carboxymethyl cellulose, hydroxyethyl cellulose) saccharoses (e.g., agar, sodium alginate, starch, carboxymethyl starch), and a synthetic compound such as polyvinyl, alcohol, poly-N-vinylpyrrolidone, polyacrylate, polyacrylamide; (2) a water-dispersible binder, for example, latex such as styrene-butadiene copolymer latex, styrene-maleic anhydride copolymer latex; and (3) an organic solvent-soluble binder such as nitrocellulose, ethyl cellulose or polyester. These binders can be used in the form of solution or dispersion in a solvent in the invention, and the binder can be varied depending upon the type of the solvent for the color developer.

On the other hand, the color formers which cause color forming reactions with the developers are a substantially colorless electron donating organic compounds, which include the triarylmethane compounds, the diphenylmethane compounds, the xanthene compounds, the triazine compounds and the spiropyran compounds, for example, as disclosed in U.S. Pat. Nos. 3,551,181; 3,514,310; 3,506,471; 3,501,331; 3,617,335; 3,514,311, etc. Examples of these compounds include 3,3-bis-(p-dimethylaminophenyl)-6-dimethylaminophthalide, i.e., Crystal Violet lactone (described as CVL), 3,3-bis-(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)-phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide and 3-p-dimethylaminophenyl-3-(1-methylpyrol-2-yl)-6-dimethylaminophthalide as triarylmethane compounds, 4,4-bis-dimethylaminobenzhydrine benzyl ether, N-halophenylleuco-Auramine and N-2,4,5-trichlorophenyl-leuco Auramine as diphenylmethane compounds, Rhodamine-B-anilino lactam, Rhodamine-(p-nitroanilino)-lactam, Rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)fluoran, 3,7-diethylaminofluoran, 7-diethylamino-3-(dibenzylamino)-fluoran, 7-diethylamino-3-(methylbenzylamino)fluoran, 7-diethylamino-3-(chloroethylmethylamino)fluoran and 7-diethylamino-3-(diethylamino)fluoran as xanthene compounds, benzoyl leuco Methylene Blue and p-nitrobenzyl leuco Methylene Blue as thiazine compounds, and 3-methyl-spiro-dinaphthopyran, 3-ethyl-spiro-dinaphthopyran, 3,3-dichloro-spiro-dinaphthopyran, 3-benzyl-spiro-dinaphthopyran, 3-methylnaphtho-(3-methoxybenzo)spiropyran and 3-propylspiro-dibenzopyran as spiro compounds.

The color formers can be dissolved in synthetic or natural oils such as chlorinated diphenyl, chlorinated terphenyl, alkylated diphenyl, alkylated terphenyl, chlorinated paraffin, chlorinated naphthalene, alkylated naphthalene, kerosine, paraffin and naphthene oil and applied to a support together with a binder, or they can be encapsulated using the method described in U.S. Pat. No. 2,800,457 and applied to a support. Further, in another embodiment, a solution of the color former can be applied only to a part of the support which needs to develop the color. The color formers and the developers can be used in any state when they are used for pressure sensitive recording papers as described in U.S. Pat. Nos. 2,505,470; 2,505,489; 2,458,366; 2,550,771; 2,712,507; 2,730,457; and 3,293,060, heat sensitive duplicating papers as described in U.S. Pat. No. 2,939,009 and all other uses.

In the following, the present invention will be explained in greater detail by reference to the following examples. From these examples, the excellent effects of the present invention will become clear.

Developer sheets, color former sheets and desensitizing inks used in order to confirm the effects of the desensitizers in the Examples were produced using the following methods. In the following, all parts and percents are by weight, unless otherwise indicated.

Preparation of Developer Sheet A

After 100 parts of sulfuric acid treated acid clay were dispersed in 280 parts of water containing 10 parts of 20% sodium hydroxide using a homogenizer, 10 parts of a 10% aqueous solution of a sodium salt of a methylvinyl ether-maleic anhydride copolymer (Commercial name: GANTREZ-AN-119, produced by General Aniline & Film Corp. molar ratio 1:1, intrinsic viscosity 0.1 to 0.5) and 37 parts of a styrenebutadiene latex (Commercial Name: Dow Latex, produced by Dow Chemical Company, molar ratio styrene 53% to butadiene 47%, molecular weight about 10,000–20,000) were added thereto. The mixture was applied using air-knife coating to a sheet of paper of a weight of 50 g/m$^2$ in an amount of 10 g/m$^2$ of solids content. After drying, Developer Sheet A was obtained.

Preparation of Developer Sheet B 170 parts of paraphenyl phenol, 70 parts of a 37% aqueous solution of formaldehyde and 50 parts of water were condensed at 160° C in the presence of concentrated (37%) hydrochloric acid (catalyst). After cooling, the product was powdered to produce a phenol resin.

50 parts of this phenol resin, 10 parts of polyvinyl alcohol (Commercial name: PVA-205, produced by Kurare Co., Ltd., degree of polymerization 500, degree of saponification 88%) and 500 parts of water were treated in a ball mill for 10 hours to produce a coating solution (Coating Solution B).

This coating solution was applied to a sheet of paper of a weight of 50 g/m² in an amount to provide a solids content of 2 g/m². After drying, Developer Sheet B was obtained.

Preparation of Developer Sheet C

4parts of sodium hydroxide were dissolved in 200 parts of water and 25 parts of 3,5-di-tert-butylsalicylic acid were dissolved in the resulting solution.

A solution which was prepared by dissolving 7 parts of zinc chloride in 100 parts of water was slowly added to the resulting solution with stirring. To the resulting mixture, 50 parts of a 10% aqueous solution of polyvinyl alcohol (Commercial name: PVA 205, produced by Kurare Co., Ltd.) were added and the mixture was treated in a ball mill for 10 hours to produce Coating Solution C.

This coating solution was applied to a sheet of paper of a weight of 50 g/m² in an amount to provide a solids content of 2 g/m². After drying, Developer Sheet C was obtained.

Preparation of Developer Sheet D

A coating solution produced by treating a mixture of 35 parts of the above-described Coating solution B, 50 parts of the above-described Coating Solution C and 15 parts of agalmatolite clay in a ball mill for 10 hours was applied to a sheet of paper of a weight of 50 g/m² so as to provide a solids content of 2 g/m². After drying, Developer Sheet D was obtained.

Preparation of Color Former Sheet A 10 parts of acid-treated gelatin having an isoelectric point of 8.0 and 10 parts of gum arabic were dissolved in 60 parts of water at 40° C. After adding 0.2 parts of sodium dodecylbenzene sulfonate as an emulsifier, 50 parts of a color-forming agent oily solution were added thereto for emulsification.

The color-forming agent oily solution was prepared by dissolving 2.5% by weight of Crystal Violet lactone and 20% by weight of benzoyl leuco Methylene Blue in an oily liquid mixture of 4 parts of diisopropyl biphenyl and 1 part of kerosene.

The emulsification was stopped by adding 100 parts of water at 40° C when the emulsified drops had an average particle size of 8 microns.

Further, 210 parts of water at 30° C were added with stirring and the pH of the system was adjusted to 4.4 by adding 20% hydrochloric acid. After cooling the solution to 8° C with stirring, 1.5 parts of 20% glutaric aldehyde was added.

Then, 30 parts of a 10% carboxymethyl starch solution were added thereto. After adjusting the pH to 8.5 by adding 25% sodium hydroxide dropwise, the solution was warmed to 30° C to produce microcapsules having hardened cell walls.

After 10 parts of cellulose flock (length about 100 $\mu$, diameter about 10 $\mu$) were dispersed in this solution, the mixture was applied to a sheet of paper of a weight of 40 g/m² so as to provide a solids content 6 gm² to produce Color Former Sheet A.

Preparation of Color Former Sheet B

1% by weight of Crystal Violet lactone, 4% by weight of 3-diethylamino-7-diethylaminofluoran, 4% by weight of 3-diethylamino-7-phenylaminofluoran, 3% by weight of 3-diethylamino-7,8-benzofluoran, 0.5% by weight of 3,6-bismethoxyfluoran and 2% by weight of benzoyl leuco Methylene Blue were dissolved in an oily liquid mixture of 1 part of diisopropylnaphthalene, 1 part of diisopropylbiphenyl and 2 parts of 1-(dimethylphenyl)-1-phenylethane to produce an color former oily solution. Using this solution, Color Former Sheet B was produced in the same manner as described for Color Former Sheet A.

Preparation of Desensitizing Inks

Desensitizing inks were produced by adding 10 parts of titanium oxide to a heated varnish of 60 parts of a desensitizer as described in the following table and 30 parts of a rosin modified maleic acid resin (Commercial name: Hitalac X24, produced by the Hitachi Chemical Co., Ltd., a reaction product of rosin with maleic anhydride followed by esterification with a glyceride, acid value 150), blending using a 3-roll mill, and adjusting the viscosity to 200 poises by adding polyethylene glycol (average molecular weight: 400).

These desensitizing inks were applied by printing to each developer sheet so as to provide 2 g/m² on a solids basis.

Method of Examination

Each developer sheet was printed with the above desensitizer. After facing the desensitized part to the color former sheet, a pressure of 600 kg/cm² was applied to cause color forming. After allowing the assembly to stand for a day and night, the density was determined using a micro-densitometer. The desensitizing effect was evaluated by the resulting reflection optical density (Vis. D).

| Example No. and Comparison No. | Desensitizer | Desensitizing Effect (Vis. D) | | | | |
|---|---|---|---|---|---|---|
| | | Color Former Sheet A | | | | Color Former Sheet B |
| | | Developer Sheet A | Developer Sheet B | Developer Sheet C | Developer Sheet D | Developer Sheet A |
| Example 1 | 1,2-Dimethylimidazoline | 0.02 | 0.01 | 0.02 | 0.02 | 0.02 |
| Example 2 | 1-Methyl-2-octylimidazoline | 0.02 | 0.02 | 0.01 | 0.02 | 0.02 |
| Example 3 | 1-2-Dimethyl-1,4,5,6-tetrahydropyrimidine | 0.02 | 0.02 | 0.03 | 0.01 | 0.02 |
| Example 4 | 1,2,4-Trimethyl-1,4,5,6-tetrahydropyrimidine | 0.01 | 0.02 | 0.02 | 0.02 | 0.02 |
| Example 5 | 3:1* Reaction Product of 1-Methylimidazoline and Nonylphenol | 0.01 | 0.01 | 0.03 | 0.01 | 0.01 |
| Example 6 | 4:1* Reaction Product of 1-Methyl-1,4,5,6-tetrahydropyrimidine and Acrylic Acid | 0.01 | 0.01 | 0.01 | 0.02 | 0.02 |
| Example 7 | 1:1* Reaction Product of | 0.01 | 0.02 | 0.02 | 0.02 | 0.02 |

-continued

| Example No. and Comparison No. | Desensitizer | Desensitizing Effect (Vis. D) | | | | |
|---|---|---|---|---|---|---|
| | | Color Former Sheet A | | | | Color Former Sheet B |
| | | Developer Sheet A | Developer Sheet B | Developer Sheet C | Developer Sheet D | Developer Sheet A |
| Example 8 | 1-Ethyl-2-octyl-1,4,5,6-tetrahydropyrimidine and Oleic Acid 5:1* Reaction Product of 1-Methyl-2-butyl-1,4,5,6-tetrahydropyrimidine and Salicylic Acid | 0.01 | 0.01 | 0.02 | 0.02 | 0.02 |
| Comparison 1 | No Desensitizing Treatment | 1.08 | 1.05 | 0.94 | 1.04 | 1.05 |
| Comparison 2 | $C_{12}H_{25}NH$ | 0.35 | 0.40 | 0.45 | 0.35 | 0.40 |
| Comparison 3 | $C_{18}H_{35}-N(CH_2-CH_2O)_xH(CH_2-CH_2O)_yH$ (x + y = 10) | 0.05 | 0.10 | 0.15 | 0.12 | 0.11 |
| Comparison 4 | Precondensate of Urea-Formaldehyde Resin** | 0.24 | 0.42 | 0.39 | 0.36 | 0.45 |
| Comparison 5 | $(C_3H_5)_3N$ | 0.33 | 0.40 | 0.42 | 0.39 | 0.42 |
| Comparison 6 | $HO(CH_2-CH_2O)_xH$ (x = 10) | 0.28 | 0.35 | 0.37 | 0.36 | 0.34 |

* ratio by weight

** Reaction product obtained from a mixture of 1 part by weight of urea and 1.75 parts by weight of 30% formaldehyde adjusted to pH of 7 using NaOH followed by heating at 70° C for 1 hour.

It is clear from the results contained in this table that the compounds of the present invention are quite useful.

Namely, the lower the values in the table which show the desensitizing effect, the better the desensitizing effect becomes. Values below 0.05 show a completely desensitized condition.

By applying the compositions of the present invention, desensitigation resulted to the extend of 1/50 to 1/200 of the density obtained in the absence of any desensitizing treatment (Comparison 1). This means that the desensitizing effect of the present invention is 2 to 30 times larger than that of the prior art desensitizers (Comparison 2 to 6).

Although the compound represented by Comparison 3 is the more preferable of the prior art desensitizers, the desensitizing effect thereof changes depending on the kind of color former. On the contrary, the desensitizers of the present invention are very useful because they exhibit a high desensitizing effect regardless of the color former used and they have no specificity to particular color formers.

While the invention has been described in detail and with reference to specific embodiments thereof, it will be apparent to one skilled in the art that various changes and modifications can be made therein without departing from the spirit and scope thereof.

What is claimed is:

1. In a method of forming color images on a color recording material wherein said color images are formed by the reaction between a substantially colorless color former and a developer, the improvement which comprises desensitizing portions of the color recording material where the formation of color images is not required by applying to the developer in these portions before contact with the colorless color former a desensitizer composition containing at least one of an amidine represented by the general formula (I)

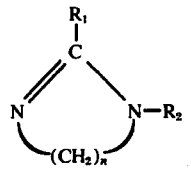

(I)

wherein $R_1$ and $R_2$ each represent an alkyl group having 1 to 8 carbon atoms, $R_1$ and $R_2$ can form a $C_2$ to $C_{11}$ ring which can be substituted by alkyl groups having 1 to 4 carbon atoms, and *n* represents 2 to 6, or an amidine derivative which is the reaction product of an amidine of the general formula (I) with a phenol, a carboxylic acid, carbonic acid or phosphoric acid whereby said desensitizer composition desensitizes portions of a recording material utilizing color formation by the contact between a substantially colorless color former and a developer where the formation of color images is not desired.

2. The method of claim 1, wherein said alkyl group is a methyl group, an ethyl group, a propyl group, a butyl group or an octyl group.

3. The method of claim 1, wherein said amidine is 1-methylimidazoline, 1,2-dimethylimidazoline, 1-methyl-2-ethylimidazoline, 1-methyl-2-octylimidazoline 1-methyl-1,4,5,6-tetrahydropyrimidine, 1,2-dimethyl-1,4,5,6-tetrahydropyrimidine, 1-methyl-2-ethyl-1,4,5,6-tetrahydropyrimidine, 1-methyl-2-butyl-1,4,5,6-tetrahydropropyrimidine, 1-ethyl-2-octyl-1,4,5,6-tetrahydropyrimidine or 1,2,4-trimethyl-1,4,5,6-tetrahydropyrimidine.

4. The method of claim 1, wherein said phenol is a monohydric phenol, a dihydric phenol, or a polyhydric phenol.

5. The method of claim 1, wherein said carboxylic acid is a saturated aliphatic acid, an unsaturated aliphatic acid, an isoalkyl aliphatic acid, a hydroxy aliphatic acid, or an aromatic acid.

6. The method of claim 1, wherein said acid is carbonic acid or phosphoric acid.

7. The method of claim 1, wherein said amidine is present in an amount of from 1 to 300% by weight.

8. The method of claim 1, wherein said desensitizer composition further comprises a natural or synthetic high molecular weight compound and an inorganic pigment improving printability, whiteness and hiding power.

9. The method of claim 8, wherein said desensitizer composition further comprises a solvent.

10. The method of claim 8, wherein said desensitizer composition further comprises a lubricant.

11. The method of claim 8, wherein said desensitizer composition further comprises an offset preventing agent.

12. The method of claim 8, wherein said desensitizer composition consists essentially of the recited components.

13. The method of claim 8, wherein said natural or synthetic high molecular weight compound is selected from the group consisting of ketone resins, polyamide resins, maleic acid resins, fumaric acid resins, phenol resins, epoxy resins, alkyd resins, melamine resins, urea resins, acrylic resins, nitrocellulose, methylcellulose, cellulose acetate butyrate, butyral resins, casein, gelatin and polyvinyl alcohol.

* * * * *